US008033305B2

(12) United States Patent
Weh et al.

(10) Patent No.: US 8,033,305 B2
(45) Date of Patent: Oct. 11, 2011

(54) ACTUATING DEVICE FOR A RAPID COUPLING

(76) Inventors: Erwin Weh, Illertissen (DE); Wolfgang Weh, Illertissen (DE)

( * ) Notice: Subject to any disclaimer, the term of this patent is extended or adjusted under 35 U.S.C. 154(b) by 1119 days.

(21) Appl. No.: 10/579,695

(22) PCT Filed: Nov. 19, 2004

(86) PCT No.: PCT/EP2004/013174

§ 371 (c)(1),
(2), (4) Date: May 21, 2007

(87) PCT Pub. No.: WO2005/050078

PCT Pub. Date: Jun. 2, 2005

(65) Prior Publication Data

US 2007/0277905 A1 Dec. 6, 2007

(30) Foreign Application Priority Data

Nov. 19, 2003 (DE) ..... 203 17 914 U

(51) Int. Cl.
*B67C 3/00* (2006.01)

(52) U.S. Cl. ..... 141/218; 141/206; 141/301

(58) Field of Classification Search ..... 141/206, 141/218, 301, 302, 346–349; 285/35, 311, 285/312, 316, 321, 322
See application file for complete search history.

(56) References Cited

U.S. PATENT DOCUMENTS

| | | | | |
|---|---|---|---|---|
| 2,030,510 | A * | 2/1936 | Griffiths | 251/101 |
| 2,686,626 | A * | 8/1954 | Slattery | 141/207 |
| 3,273,609 | A * | 9/1966 | Carder et al. | 141/206 |
| 5,060,982 | A * | 10/1991 | Matsushita | 285/190 |
| 5,301,723 | A * | 4/1994 | Goode | 141/82 |
| 5,575,510 | A * | 11/1996 | Weh et al. | 285/35 |
| 6,099,044 | A * | 8/2000 | Weh et al. | 285/33 |
| 7,588,060 | B2 * | 9/2009 | Ballard | 141/226 |

FOREIGN PATENT DOCUMENTS

| | | | |
|---|---|---|---|
| EP | 0 122 404 | A | 10/1984 |
| EP | 1 006 310 | A | 6/2000 |
| NL | EP 0039977 | A1 * | 8/1981 |
| WO | WO 93/20378 | A | 10/1993 |
| WO | WO 98/04866 | A | 2/1998 |
| WO | WO 00/69894 | | 11/2000 |
| WO | WO 03/033522 | A1 | 4/2003 |
| WO | WO 03/090774 | A1 | 11/2003 |

(Continued)

OTHER PUBLICATIONS

Crosdale, D. J, et al., "Mannose-Binding Lectin Gene Polymorphisms as a Susceptibility Factor for Chronic Necrotizing Pulmonary Aspergillosis," *JID*, 2001, pp. 653-656, vol. 184.

(Continued)

*Primary Examiner* — Timothy L Maust

(74) *Attorney, Agent, or Firm* — Knobbe Martens Olson & Bear LLP

(57) ABSTRACT

In order to create a simply designed actuating device with a reliable handling for a rapid coupling (10) for transferring gaseous and/or liquid fluids, comprising a tubular housing (11) and a slide (41), which is mounted in a manner that enables it to be displaced relative to the housing and which is coupled to a lever mechanism (42), the invention provides that the lever mechanism (42) has at least one pivoting lever (43) laterally mounted inside said housing (11).

12 Claims, 2 Drawing Sheets

FOREIGN PATENT DOCUMENTS

| | | | |
|---|---|---|---|
| WO | WO 2004/089394 | A2 | 10/2004 |
| WO | WO 2006/067807 | A1 | 6/2006 |

OTHER PUBLICATIONS

Neth, O., et al., "Interaction of Human Mannose-Binding Lectin (MBL) to Organisms Isolated from Immunocompromised Children," p. 362, (Abstract).

Neth, O., et al., "Mannose-Binding Lectin Binds to a Range of Clinically Relevant Microorganisms and Promotes Complement Deposition," *Infection and Immunity*, 2000, pp. 688-693, vol. 68 (2).

Valdimarsson, H., et al., "Reconstitution of Opsonizing Activity by Infusion of Mannan-Binding Lectin (MBL) to MBL-Deficient Humans," *Scand. J. Immunol*., 1998, pp. 116-123, vol. 48.

* cited by examiner

ACTUATING DEVICE FOR A RAPID COUPLING

The invention relates to an actuating device for rapid coupling for transferring gaseous and/or liquid fluids according to preamble features of claim 1.

Such rapid couplings should ensure a secure and rapid connectability for transferring a fluid from a pressure source, especially from a gas tank at a gas station for filling vehicles. The especially important aspect is the simple easy usability of the rapid coupling, so that even under adverse conditions such as high connecting pressures or technically unskilled persons easy handling is enabled.

Such a rapid coupling is described in WO 98/04866 of the applicant, with the rapid coupling comprising a housing with an inlet and outlet valve as well as several valves in order to ensure a secure sealing of the rapid coupling until the connection is completely established. Such valves are switched after application of the rapid coupling in a certain predetermined sequence, with the outlet valve being opened first by pushing the rapid coupling onto a connecting nipple, the tongs being closed during further movement of a control lever as the actuating apparatus, and finally the inlet valve being opened. The control lever is in engagement via an eccentric shaft with the slide sleeve for pressuring the tongs and with a central sealing piston which releases the fluid inlet after the completed connection of the insert coupling. Although a relatively secure possibility for connection is created in this way, the handling of this coupling is still relatively user-unfriendly, especially in the case of gas station customers who expect a conventional nozzle of a gasoline pump, because in addition to the insertion of the coupling it is necessary to perform the actuation of the control lever, so that single-hand operation is hardly possible.

The invention is thus based on the object of providing an actuating apparatus for a rapid coupling of the kind mentioned above which in combination with a simple configuration allows secure and simple handling.

This object is achieved by an actuating apparatus according to the features of claim 1. Preferred embodiments are the subject matter of the sub-claims.

The proposed actuating apparatus is characterized by an especially simple operation, which moreover is especially secure. Especially for the preferred embodiment for filling vehicles with natural gas, the connection and detachment of the rapid coupling is performed like with a nozzle known from tanking with gasoline, namely by simple one-hand operation. This is especially important for reasons of market acceptance of natural gas stations, because customers hardly need to familiarize themselves with the new system in order to securely connect or disconnect this rapid coupling during the filling process.

Notice must be taken that the proposed actuating apparatus is suitable for different connecting shapes and connecting nipples. As a result of the lever mechanism coupled with the actuating apparatus and one, preferably two pivoting levers on the side of the housing or on both sides of the housing, a compact and secure locking of the tongs or similar locking elements is enabled. Especially important is the realization of the actuating apparatus by means of a hand lever known from gasoline pump station nozzles, so that a secure and rapid one-hand operation of the rapid coupling is enabled in a simple way. The gas station customer is moreover fully familiar with the sequence of activation.

An embodiment of the invention is explained below in closer detail by reference to the enclosed drawings, wherein.

Figure 1:
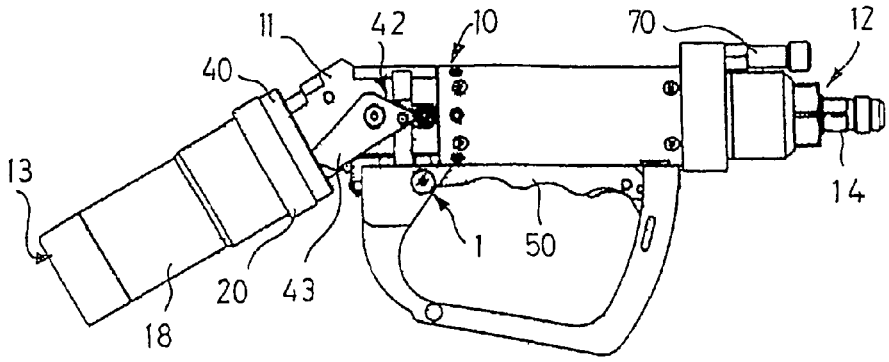
FIG. 1 shows a side view of a rapid coupling for a tank connection.
Figure 2:
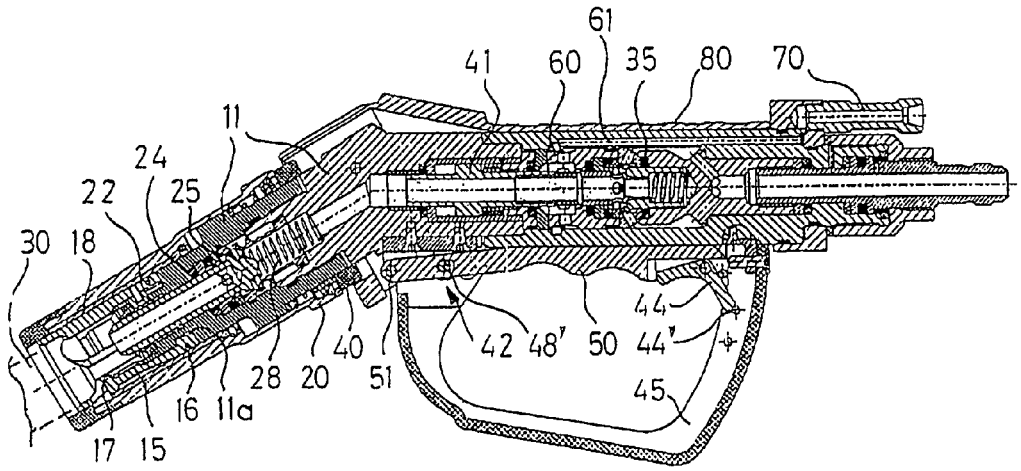
FIG. 2 shows an illustration of the rapid coupling according to FIG. 1 in a longitudinal sectional view.

FIG. 1 shows a preferred embodiment of an actuating apparatus 1 for a rapid coupling 10 for the connection to a connecting nipple 30 (cf. FIG. 2). The rapid coupling 10 comprises a tubular bent housing 11 or mutually connected housing parts, with the right side being used in this case as inlet 12 and the left side as an outlet 13 for conducting the fluid to be transferred to the connecting nipple 30. The inlet 12 to the housing 11 comprises a connection adapter 14 which can be connected to a hose or a pipe for supplying the fluid to be transferred. The connection adapter 14 can be configured to be adapted to the transferred fluid, especially the respective feed angle, flow cross sections, etc.

On the face side opposite of the connection adapter 14, namely the outlet 13, several oblong tongs 15 arranged in tubular form are provided as locking elements (cf. FIG. 2). They are spread radially to the outside prior to insertion on the connecting nipple 30, as is shown for example in WO-A-93/20378 of the applicant for example. The oblong tongs 15, of which are generally three to six, are hooked at their right end here into an annular groove 11*a* of the housing 11 and pretensioned by an annular spring 16, so that the tongs 15 are spread radially to the outside. At the left end on the inwardly bent surface, the tongs 15 each comprise positive-locking engagement profiles 17 which are configured correspondingly to the connecting nipple 30.

An outer sliding sleeve 18 is provided about the tongs 15, which sleeve is held on the cylindrical outside jacket of the housing 11 in the manner of a rotary transmission leadthrough and can be advanced axially with the actuating apparatus 1 in the direction towards the connecting nipple 30, as will be explained below. The sliding sleeve 18 comprises an extension 20 which allows the axial displacement of the sliding sleeve 18 towards the actuating apparatus 1 in the middle region of the rapid coupling 10, as a result of which the tongs 15 are arrested by the wrap-around by means of the sliding sleeve 18 in the connecting position. Moreover, this component on the outlet side can be rotated relative to the middle switching or actuating unit in order to connect the coupling 10 in any desired rotary position.

As is shown in a longitudinal sectional view of FIG. 2, a sealing piston 22 is guided on the inside surface of the housing 11 situated towards the outlet 13, which piston rests on a sealing surface of the connecting nipple 30. The sealing piston 22 is sealed relative to the tongs 15 with several sealing rings 24 which are inserted at the front end of the housing 11, so that the gaseous and/or liquid fluid flowing along the central axis of the rapid coupling 10 cannot escape to the outside.

Relevant is further an outlet valve 25 which is held centrally on the housing 11. The outlet valve 25 is pressurized by a pressure spring 28 which is guided in the housing 11. Said outlet valve 25 ensures that the fluid supplied by the connection adapter 14 cannot flow out even with opened connecting cock on the filling station shortly before the connection of the rapid coupling 10 to the connecting nipple 30. The outlet valve 25 is axially displaced by the sealing piston 22 upon insertion of the rapid coupling 10 on the connecting nipple 30 and the outlet valve 25 is hereby opened. An inlet valve 35 of the rapid coupling 10 is still closed. It is only opened afterwards in the following procedure by actuating apparatus 1 and an associated slide 41, as will be explained below.

Especially relevant is a sliding ring 40 which is guided on the outer circumference of the housing 11 and which is pressurized by a lever mechanism 42 which also controls the slide 41. The slide 41 is guided in the housing 11 and pressurized by a pressure spring. As is clearly shown in the illustration, the slide ring 40 is pressurized by a pivoting lever 43, as a result of which the same is displaceable from the opened position to the connected or locking position. The pivoting lever 43 is manually swiveled downwardly along the face surface of the slide ring 40 by pulling up the hand lever 50 (within the hand bracket 45), as a result of which simultaneously a stop lever 44 of the hand lever 50 latches into the hand bracket 45. A graduated catch 44' is provided in the interior of the hand bracket 45 in order to arrest the hand lever 50 in this filling position. For uncoupling, the catch 44' is released by the stop lever 44, so that the hand lever 50 can move downwardly about its axis 51 (which in this case is clockwise) (cf. FIG. 4), with the coupled components of the lever mechanism 42 thus following, meaning that the pivoting lever 43 is swiveled upwardly again with its ramp-like front surface 43' along the slide ring 40, as can be seen from a comparison between FIGS. 3 and 4.

Figure 3:
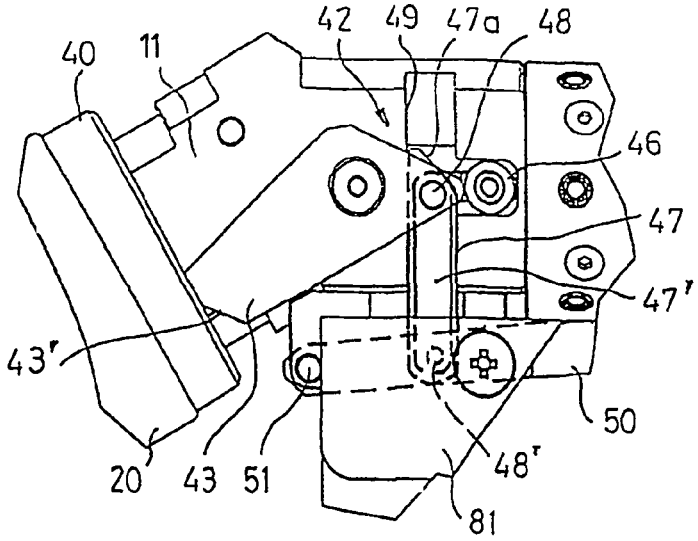
FIG. 3 shows an enlarged illustration of the middle section of FIG. 1.

The lever mechanism 42 also acts upon a roller 46 connected with the slide 41 and comprises two superimposed levers 47 and 47' whose bottom ends are joined via a common pin 48' as a joint with the hand lever 50. The outer lever 47', which is shown in FIG. 3 on a slightly smaller scale, is flexibly connected at its upper end by a pin 48 with the pivoting lever 43, so that the same is pivoted in the plane of the drawing (FIGS. 1 and 3) upon actuation of the hand lever 50 in order to axially move the slide ring 40. At the same time, the inner lever 47 is upwardly moved in a groove on the side surface of the housing 11 in a kind of a connecting link 49 in order to pressurize with a wedge surface 47*a* the roller 46 in the axial direction. The thus connected slide 41 is thereby pressed against the inlet valve 35, so that the same is moved to the opened position. The slide 41 is pressurized by a pressure spring (cf. three-dimensional illustration in FIG. 4), so that the roller 46 rests on the wedge surface 47*a* of the inner lever 47. Preferably, the slide 41 is provided not only for the controlled opening of the inlet valve 35, but also for actuating an interposed venting valve 60. This leads to a venting connection 70 via a bore 61 arranged in the housing 11 (cf. FIG. 2), so that any gas or fluid remaining in the rapid coupling 10 can be returned. This venting valve 60 which is also co-actuated by the slide 41 also facilitates uncoupling, because a defined pressure decrease can thus occur.

Notice shall be taken concerning the lever mechanism 42 and the thereby pressurized roller 46 on the side of the slide 41 that the embodiment shown herein can also be realized by a slideway instead of the roller 46 or with other dimensions of the levers 47, 47' in order to realize the relevant force multiplication ratio of the manual force on the hand lever 50. The wedge surface 47*a* as shown here in combination with the ramp-like front surface 43' on the pivoting lever 43 come with the advantage that a high force multiplication ratio is achieved by the incline during the rolling off of the roller 46 and by the displacement along the slide ring 40, so that the thus connected slide 41 and sliding ring 40 can raise very high valve opening forces upon the inlet valve 35 and the venting valve 60 as well as the outlet valve 25. This ratio is also supported by the lengths of the levers 47 and 47' of the lever mechanism 42 and the lever ratio of the hand lever 50 (distance between fulcrum 51 and linkage point of pin 48'). Notice must be taken that one such lever mechanism 42 each is arranged in a symmetrical manner on both sides on the side surfaces of the middle area of the housing 11 which are flattened for this purpose and is linked via the (common) pin 48' to the hand lever 50. This leads to an even pressurization of the slide ring 40. Moreover, these two lever mechanisms 42 on both sides are covered by a cover 81 indicated in FIG. 3 in order to prevent soiling or injuries. This is followed by an encasing 80 which is shown in FIG. 2 and which is used in the middle section as a handle.

For detaching the rapid coupling 10 and for returning the connecting position, the stop lever 44 on the profiled hand lever 50 is slightly pulled back by hand, After a short pivoting path, the hand lever 50 is released (downwardly), as a result of which the sliding sleeve 18 is retracted. The tongs 15 can thus spread again radially to the outside, with the slide 41 being displaced simultaneously via the lever mechanism 42 to the left here and the pivoting lever 43 being swiveled upwardly first in order to allow the slide ring 40 to follow axially to the right here. Before the sealing contact between the sealing piston 22 and the connecting nipple 30 is detached, the outlet valve 25 is closed in a manner of a sequential control. As a result of this virtually simultaneous sequence, a very rapid closure of the inlet and outlet valves 35 and 25 is achieved, so that no fluid volume is allowed to escape.

Figure 4:
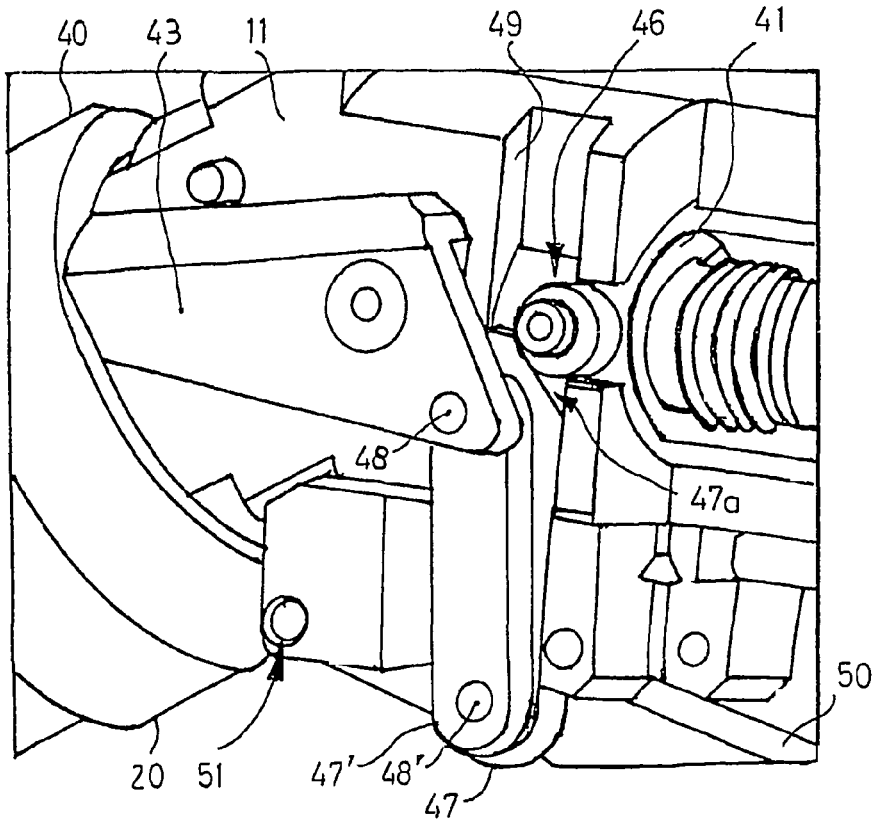
FIG. 4 shows a perspective view according to FIG. 3.

The pivoting lever 43 in combination with the force-multiplication lever mechanism 42 also allows a power-saving coupling of the rapid coupling 10 with the connecting nipple 30, with the tongs 30 only being closed when the sealing contact is ensured because the opened position of the tongs 15 (or other locking elements such as balls) is maintained until the opened position of the tongs 15 is released by the axial displacement of the sealing piston 22 and the slide ring 40 in direct sequence in order to produce the connection. FIG. 4 shows a three-dimensional illustration with respect to FIG. 3, with the respective components being designated with the same reference numerals as in FIGS. 1 and 2. The lever mechanism 42 which is relevant here has the same configuration, with the slide 41 and the slide ring 40 as actuated by the same being shown in a schematic illustration. As a result of the axial movement of the slide 41 (to the right in this case), the gas passage is released and as a result of the movement of the slide ring 40 (which in this case is to the left), the outlet valve 25 is opened in a defined sequence, as described above.

The invention claimed is:

1. An actuating apparatus for a rapid coupling for transferring gaseous and/or liquid fluids, comprising a tubular housing and a slide which is mounted in a manner that enables it to be displaced relative to the housing and which is coupled with a lever mechanism wherein the lever mechanism comprises at least one pivoting lever which is laterally mounted on the housing, and wherein the lever mechanism comprises two superimposed levers, with an inner lever resting on a roller which is connected with the slide.

2. An actuating apparatus according to claim 1, wherein two pivoting levers are provided on both sides on the housing in a mirror-inverted manner.

3. An actuating apparatus according to claim 1, wherein a front surface of the at least one pivoting lever pressurizes a slide ring of a rotary transmission leadthrough on the outlet side.

4. An actuating apparatus according to claim 1, wherein a contact surface of the at least one pivoting lever is arranged towards the roller as a wedge surface.

5. An actuating apparatus according to claim 1, wherein the at least one pivoting lever is guided in a connecting link of the housing.

6. An actuating apparatus according to claim 1, wherein an outlet valve and an inlet valve are provided in the housing, between which there is arranged a venting valve which can be actuated by the slide.

7. An actuating apparatus according to claim 1, wherein the at least one pivoting lever is connected with a hand lever via a lever.

8. An actuating apparatus according to claim 3, wherein the front surface of the at least one pivoting lever comprises an initially flatter incline for force multiplication on the slide ring.

9. An actuating apparatus according to claim 1, wherein a connection process of the rapid coupling is controlled at least partly by the lever mechanism.

10. An actuating apparatus according to claim 1, wherein a pin is provided as a joint, on which a second lever of the lever mechanism is also mounted.

11. An actuating apparatus according to claim 5, wherein a connection process of the rapid coupling is controlled at least partly by the lever guided in the connecting link or a switching valve cooperating with the hand lever.

12. An actuating apparatus for a rapid coupling for transferring gaseous and/or liquid fluids, comprising a tubular housing and a slide which is mounted in a manner that enables it to be displaced relative to the housing and which is coupled with a lever mechanism wherein the lever mechanism comprises at least one pivoting lever which is laterally mounted on the housing, wherein an outlet valve and an inlet valve are provided in the housing, between which there is arranged a venting valve which can be actuated by the slide.

* * * * *